US009142200B2

(12) United States Patent
Park et al.

(10) Patent No.: US 9,142,200 B2
(45) Date of Patent: Sep. 22, 2015

(54) WIND SYNTHESIZER CONTROLLER

(71) Applicant: Jaesook Park, Daegu (KR)

(72) Inventors: Jaesook Park, Daegu (KR); Gwangseok An, Seoul (KR)

(73) Assignee: Jaesook Park, Daegu (KR)

( * ) Notice: Subject to any disclaimer, the term of this patent is extended or adjusted under 35 U.S.C. 154(b) by 0 days.

(21) Appl. No.: 14/487,930

(22) Filed: Sep. 16, 2014

(65) Prior Publication Data

US 2015/0101477 A1 Apr. 16, 2015

(30) Foreign Application Priority Data

Oct. 14, 2013 (KR) ..... 10-2013-0121783

(51) Int. Cl.

| | |
|---|---|
| ***G10H 1/18*** | (2006.01) |
| ***G10H 7/00*** | (2006.01) |
| ***G10H 1/34*** | (2006.01) |
| ***G10H 3/26*** | (2006.01) |

(52) U.S. Cl.

CPC . *G10H 1/18* (2013.01); *G10H 1/34* (2013.01); *G10H 3/26* (2013.01); *G10H 7/002* (2013.01); *G10H 2220/211* (2013.01); *G10H 2220/311* (2013.01); *G10H 2220/361* (2013.01); *G10H 2230/195* (2013.01)

(58) Field of Classification Search

USPC ..... 84/615, 633, 658, 665
IPC ..... G10H 1/18
See application file for complete search history.

(56) References Cited

U.S. PATENT DOCUMENTS

| | | | | | |
|---|---|---|---|---|---|
| 2,774,834 | A | * | 12/1956 | Kenworthy | 200/52 R |
| 3,166,622 | A | * | 1/1965 | Neustadt | 84/699 |
| 3,439,106 | A | * | 4/1969 | Goodale | 84/711 |
| 3,483,304 | A | * | 12/1969 | Jenny | 84/724 |
| 3,557,295 | A | * | 1/1971 | Adachi | 84/699 |
| 3,617,604 | A | * | 11/1971 | Adachi | 84/688 |
| 3,733,953 | A | * | 5/1973 | Ferber | 84/724 |
| 3,767,833 | A | * | 10/1973 | Noble et al. | 84/673 |
| 4,038,895 | A | * | 8/1977 | Clement et al. | 84/687 |
| 4,085,646 | A | * | 4/1978 | Naumann | 84/633 |
| 4,151,368 | A | * | 4/1979 | Fricke et al. | 84/736 |
| 4,815,353 | A | * | 3/1989 | Christian | 84/724 |
| 4,915,008 | A | * | 4/1990 | Sakashita | 84/658 |
| 5,024,133 | A | * | 6/1991 | Nakanishi et al. | 84/615 |
| 5,036,745 | A | * | 8/1991 | Althof, Jr. | 84/656 |

(Continued)

FOREIGN PATENT DOCUMENTS

| | | | |
|---|---|---|---|
| JP | 2005-043520 | A | 2/2005 |
| JP | 2007-003576 | A | 1/2007 |

(Continued)

*Primary Examiner* — David Warren
(74) *Attorney, Agent, or Firm* — Birch, Stewart, Kolasch & Birch, LLP

(57) ABSTRACT

There is provided a wind synthesizer controller playable by the same manipulation as that of a customary musical instrument as well as able to obtain accurate scale information and volume information. The wind synthesizer controller includes a microphone, an expiration intensity measuring unit, and a controller. The microphone detects a sound generated by flowed in expiration. The expiration intensity measuring unit measures intensity of the expiration on the basis of a detected sound signal. The controller generates volume information on the basis of the measured expiration intensity. The volume information at least includes note on, note off, and velocity.

13 Claims, 5 Drawing Sheets

(56) References Cited

U.S. PATENT DOCUMENTS

| | | | | | |
|---|---|---|---|---|---|
| 5,125,315 | A * | 6/1992 | Kawashima | 84/619 |
| 5,140,888 | A * | 8/1992 | Ito | 84/723 |
| 5,170,003 | A * | 12/1992 | Kawashima | 84/619 |
| 5,189,240 | A * | 2/1993 | Kawashima | 84/724 |
| 5,245,130 | A * | 9/1993 | Wheaton | 84/742 |
| 5,508,472 | A * | 4/1996 | Hawkins | 84/653 |
| 5,508,473 | A * | 4/1996 | Chafe | 84/659 |
| 5,521,328 | A * | 5/1996 | Kakishita | 84/661 |
| 5,543,580 | A * | 8/1996 | Masuda | 84/723 |
| 5,668,340 | A * | 9/1997 | Hashizume et al. | 84/742 |
| 6,002,080 | A * | 12/1999 | Tanaka | 84/615 |
| 6,538,189 | B1 * | 3/2003 | Ethington | 84/615 |
| 7,309,827 | B2 * | 12/2007 | Sakurada | 84/616 |
| 7,321,094 | B2 * | 1/2008 | Sakurada | 84/616 |
| 7,394,012 | B2 * | 7/2008 | Schultz | 84/615 |
| 7,723,605 | B2 * | 5/2010 | Gremo et al. | 84/723 |
| 7,985,916 | B2 * | 7/2011 | Shibata | 84/621 |
| 8,569,605 | B2 * | 10/2013 | Grace | 84/454 |
| 2006/0107824 | A1 * | 5/2006 | Bando et al. | 84/616 |
| 2006/0283312 | A1 | 12/2006 | Shibata | |
| 2007/0017346 | A1 * | 1/2007 | Masuda | 84/600 |
| 2007/0017352 | A1 * | 1/2007 | Masuda | 84/658 |
| 2008/0177404 | A1 * | 7/2008 | Bonnat | 700/90 |
| 2011/0004327 | A1 * | 1/2011 | Bonnat | 700/83 |

FOREIGN PATENT DOCUMENTS

| | | | |
|---|---|---|---|
| JP | 2011-027801 | A | 2/2011 |
| KR | 10-2007-0006296 | A | 1/2007 |

* cited by examiner

WIND SYNTHESIZER CONTROLLER

CROSS-REFERENCE TO RELATED PATENT APPLICATION

This application claims the benefit of Korean Patent Application No. 10-2013-0121783, filed on Oct. 14, 2013, in the Korean Intellectual Property Office, the disclosure of which is incorporated herein in its entirety by reference.

BACKGROUND OF THE INVENTION

1. Field of the Invention

The present invention relates to a wind synthesizer controller, and more particularly, to a wind synthesizer controller playable by the same manipulation as that of a customary musical instrument as well as able to obtain accurate scale information and volume information.

2. Description of the Related Art

A typical pipe type electronic musical instrument uses a structure of measuring intensity of expiration using a pressure sensor and obtaining fingering information by including fingering holes (tone holes) as button type switches. In this structure, it lacks feeling of playing a customary musical instrument by pressing button type switches and has tendency of difficulty to generate excitement about the playing.

SUMMARY OF THE INVENTION

The present invention provides a wind synthesizer controller playable by the same manipulation as that of a customary musical instrument as well as able to obtain accurate scale information and volume information by measuring intensity of expiration using a microphone and obtaining fingering information by preparing non-contact sensors separately from fingering holes (tone holes) at positions corresponding to the fingering holes.

The technical objects of the present invention are not limited to those described above, and it will be apparent to those of ordinary skill in the art from the following description that the present invention includes other technical objects not specifically mentioned herein.

According to an aspect of the present invention, a wind synthesizer controller includes: a microphone detecting a sound generated by flowed in expiration; an expiration intensity measuring unit measuring intensity of the expiration on the basis of a detected sound signal; and a controller generating volume information on the basis of the measured expiration intensity, wherein the volume information at least comprises note on, note off, and velocity.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
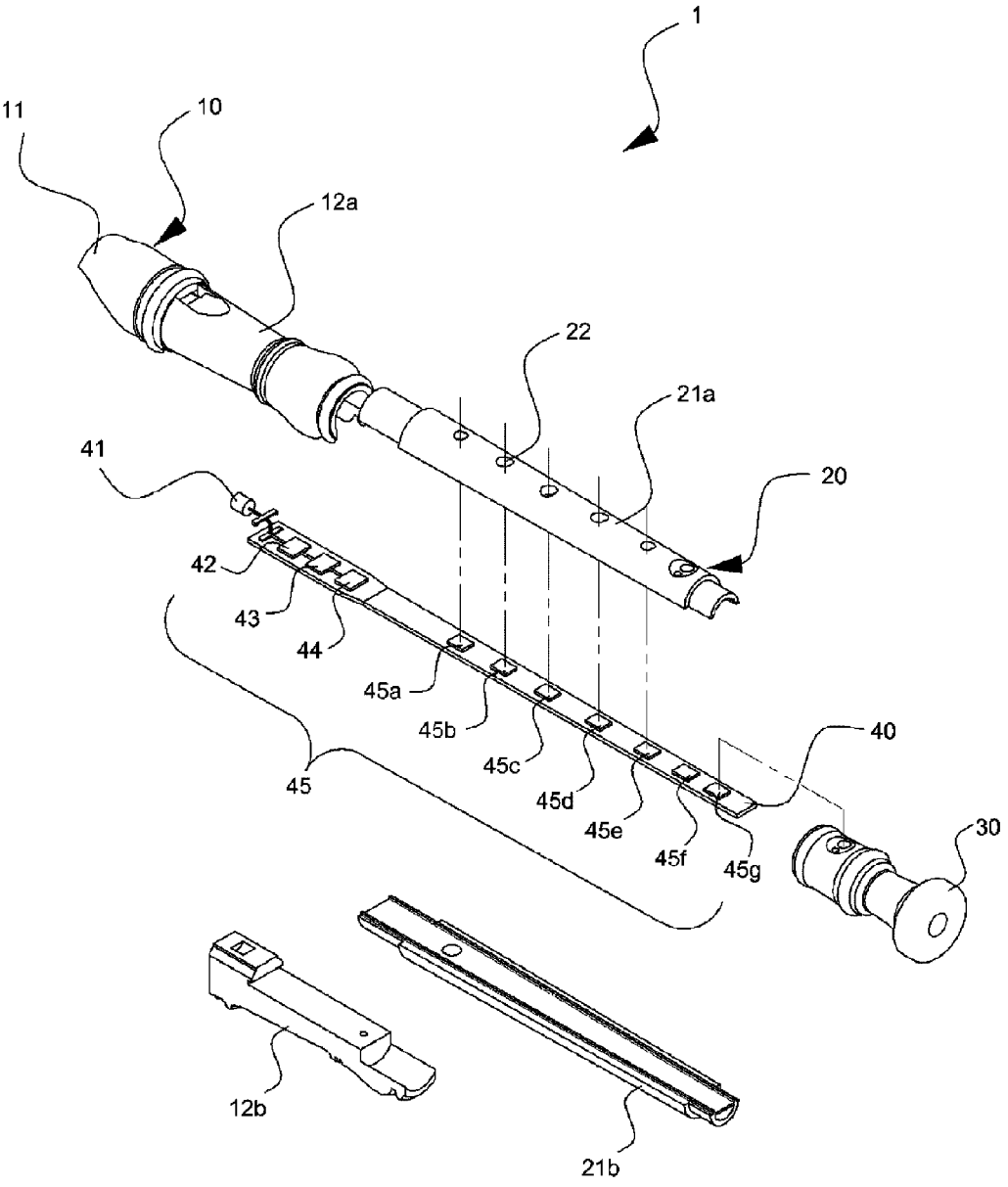
FIG. 1 is an exploded perspective view of a wind synthesizer controller according to an embodiment of the present invention.

Hereinafter, preferred embodiments will be described in more detail with reference to the accompanying drawings. Moreover, detailed descriptions of well-known functions or configurations will be omitted in order not to unnecessarily obscure the focus of the present invention. Like reference numerals refer to like elements throughout Firstly, a wind synthesizer controller is described with reference to FIGS. 1 and 2.

Figure 2:
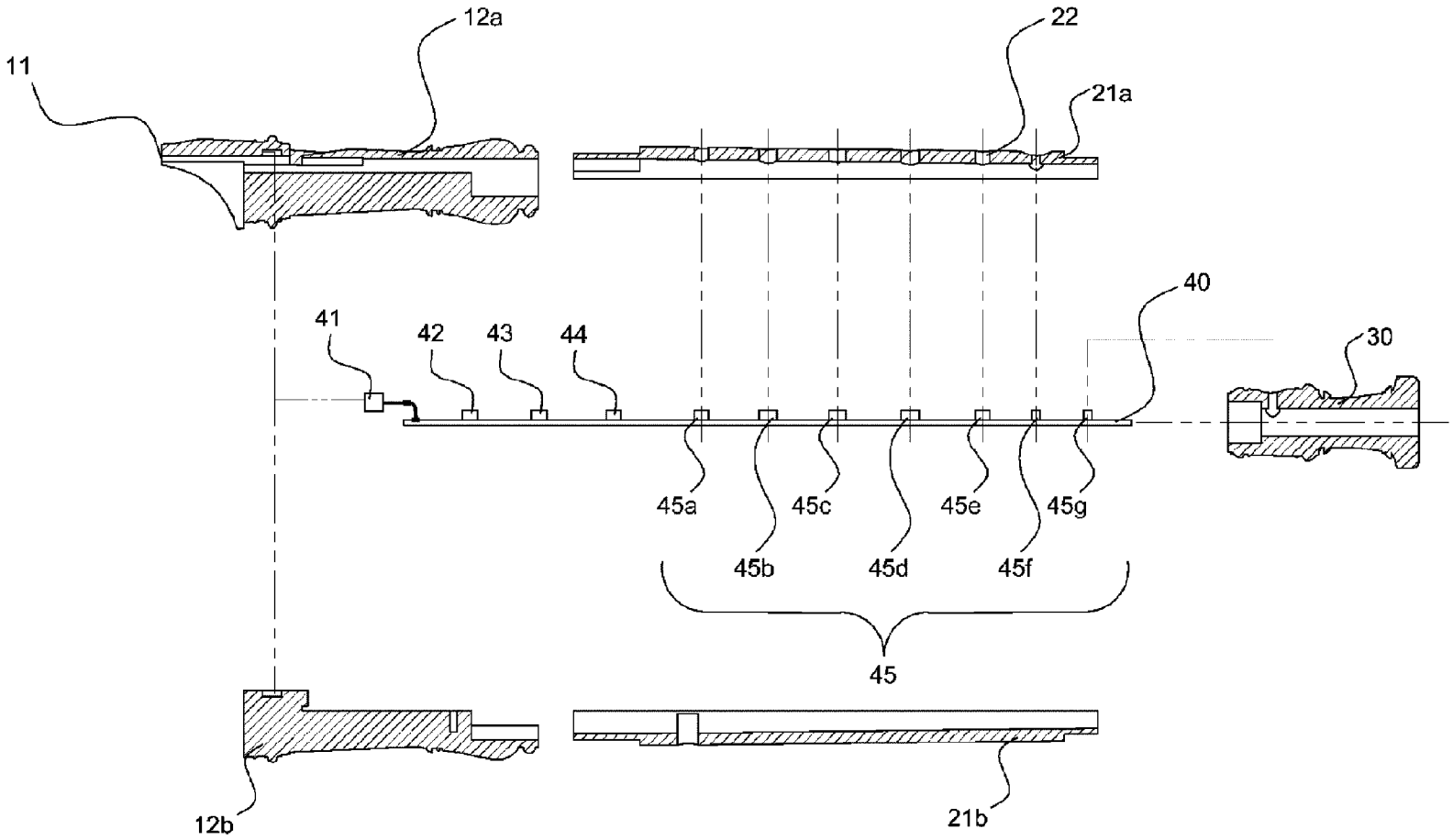
FIG. 2 is a side cross-sectional view of a wind synthesizer controller illustrated in FIG. 1.

FIG. 1 is an exploded perspective view of a wind synthesizer controller according to an embodiment of the present invention, and FIG. 2 is a side cross-sectional view of the wind synthesizer controller illustrated in FIG. 1.

Referring to FIGS. 1 and 2, the wind synthesizer controller 1 may at least include an upper pipe 10, an intermediate pipe 20, and a lower pipe 30 forming an appearance, and a circuit unit 40 generating scale information and volume information.

In the embodiment, even though this wind synthesizer controller 1 is implemented such that an appearance thereof has a pipe shape like a recorder, it is not limited thereto and all types useable as a wind instrument are possible.

An appearance structure of the wind synthesizer controller 1 is described in detail. The upper pipe 10 may include an embouchure hole 11 formed at a mouthpiece side, an upper plate 11*a* and a lower plate 11*b* forming a delivering path (windway) of expiration flowed in through the embouchure hole 11. Here, the lower plate 11*b* is inserted inside the upper plate 11*a* and an internal space, namely, the delivering path (windway) of expiration, is formed to allow expiration flowed in from the embouchure hole 11 to be delivered to a microphone 41 of the circuit unit 40.

The intermediate pipe 20 may include an upper plate 21*a* having at least one fingering hole (tone hole) 22 formed therethrough, a lower plate 21*b* and the upper plate 21*a*, and the lower plate 21*b* may be combined to form an internal space in which the circuit unit 40 is embedded. At this point, the circuit unit 40 is embedded in the formed internal space, and a space is generated over the circuit unit 40, which is separated by a predetermined interval from the upper plate 21*a* of the intermediate pipe 20 through which the fingering holes are formed. Accordingly, a proximity sensor 45 of the circuit unit 40 may be separated from the fingering holes 22.

The lower pipe 30 may be combined in a type of being inserted into one side end of the intermediate pipe 20 and play a role of maintaining and fixing a combination of the upper plate 21*a* and the lower plate 21*b* of the intermediate pipe 20.

The circuit unit 40 may at least include the microphone installed on a substrate and detecting a sound generated by expiration flowed in, an expiration intensity measuring unit 42 measuring expiration intensity on the basis of the detected sound signal, a controller 43 converting scale information generated on the basis of a detection signal of the proximity sensor 45 into a musical instrument digital interface (MIDI) signal and output the MIDI signal, a communication unit 44 transmitting the MIDI signal, and the proximity sensor 45 generating the detection signal according to contacts of fingers to the fingering holes 22.

The microphone 41 in the embodiment may use a condenser microphone, but is not limited hereto and may be selected suitably for a function desired by a user.

This microphone 41 may detect a sound generated by expiration blown by a player through the embouchure hole 11, and output the detected sound signal as an electrical signal. Here, the output electrical signal may be an AC voltage having a waveform.

The expiration intensity measuring unit 42 may filter the electrical signal output from the microphone 41 to have a specific frequency band, and measure the expiration intensity by converting the filtered frequency into a DC voltage output. Furthermore, description about a configuration and an operation of the expiration intensity measuring unit 42 will be provided below in detail with reference to FIG. 3.

When fingers contact the fingering holes 22, the proximity sensor 45 may detect this and generate a detection signal. The proximity sensor 45 may be a non-contact sensor installed at a position corresponding to and separated from the fingering holes 22.

For example, the proximity sensor 45 may be configured with an infrared sensor including a light emitting unit periodically generating an infrared ray and a light receiving unit receiving the infrared ray.

In such a way, since the proximity sensor 45 is implemented with a non-contact sensor, the fingering holes having the same structure as a customary musical instrument may be formed and the player may play with the same touch feeling as the customary musical instrument.

For accurate detection of finger contacts, the proximity sensor 45 may generate identification information with light rays such as infrared rays, and detect light rays and the identification information reflected by the fingers and generate the detection signal. Through this, meaningless signals such as infrared rays included sunlight, other than reflection by the fingers, may be removed and only the detection signal by actual finger contacts may be identified.

Furthermore, in the present invention, the proximity sensor 45 may be implemented with two embodiments according to whether determination is performed on whether there is the actual finger contact from the detection signal.

First, the proximity sensor 45 according to a first embodiment may periodically transmit light rays and identification information for detecting finger contacts, receive light rays or light rays and identification information reflected and returned, and may generate the detection signal.

In other words, the proximity sensor 45 according to the first embodiment may generate the detection signal without verifying whether the identification information is included in the received information and deliver the detection signal to the controller 43. Thereafter, the controller 43 may analyze the delivered detection signal for whether the identification information is received, determine whether the fingers actually contacts, and then may combine corresponding fingering information.

Next, in order to detect finger contacts, the proximity sensor 45 may periodically transmit light rays and identification information, receive light rays or light rays and identification information reflected and returned, verify whether the identification information is included, and then generate the detection signal only when the identification information is included.

In other words, the proximity sensor 45 according to the second embodiment may verify whether the identification information is included in the received information, and then generate the detection signal and deliver it to the controller 43. Then, the control unit 43 may combine finger information corresponding to the delivered detection signal.

In addition, the control unit 43 may generate volume information based on expiration intensity information measured by the expiration intensity measuring unit 42, and generate scale information based on the detection signal generated by the proximity sensor 45. Here, the volume information may be note data information representing note on, note off, and velocity. The scale information may be information representing scales corresponding to fingering positions at which the fingers of the player are positioned.

In detail, the controller 43 may compare the measured expiration intensity information with a set first threshold value. As the comparison result, if the measured expiration intensity is not smaller than the first threshold value, the control unit 43 may generate note on information. Otherwise, the control unit 43 may generate note off information. Here, the first threshold value may be a value for distinguishing the note on from the note off of sound.

Furthermore, the control unit 43 may compare the measured expiration intensity information with a second threshold value. If the measured expiration value is not smaller than the second threshold, the control unit 43 may generate velocity information corresponding to the measure expiration intensity. Here, the second threshold may be a value for distinguishing intensity (strength) of sound, and the first and second threshold values may be set identically to or differently from each other.

Furthermore, the control unit 43 may check whether identification information is included in the detection signal generated by the proximity sensor 45, determine only the detection signal including the identification information as valid data generated by actual finger contacts, and remove the detection signal that does not include the identification information.

Thereafter, the control unit 43 may grasp the fingering positions of the fingers on the basis of valid detection signal information, combine fingering information accordingly, and generate the scale information through the combined fingering information. For example, the control unit 43 may prestore matching information on the fingering information and corresponding scale information thereto and search the matching information for the scale information corresponding to the fingering information combined on the basis of the detection signal.

On the other hand, the control unit 43 may convert the generated volume and scale information into a MIDI signal. In other words, the control unit 43 may perform a MIDI processor function, convert the generated volume and scale information into the MIDI signal, and output the MIDI signal so as to be output through a sound output means (e.g., speaker).

The communication unit 44 may include a wired communication unit allowing communication with a wired electronic device on a wired network and a wireless communication unit allowing communication with a wireless electronic device over on a wireless network. Here, the wired network may use any one or more selected from USB, programmable logic controller (PLC), LAN, RS-232, RS-485, RS-422, IEEE1394, and Home phoneline networking alliance (PNA). The wireless network may use any one or more selected from ZigBee, dedicated short range communication (DSRC), radio frequency identification (RFID), Bluetooth, WLAN, WiFi, and WiBro.

The communication unit 44 transmits the converted MIDI signal to an external electronic device according to a control of the controller 43. The external electronic device may be a display device, a speaker, or a computer terminal.

In this way, by using a wind synthesizer controller according to the present invention, precise volume information may be obtained by detecting a sound generated from expiration and measuring expiration intensity. The wind synthesizer controller may be played with the same sense of touch as a customary musical instrument by detecting whether fingers contact the fingering holes by using non-contact sensors, and may obtain precise scale information by determining whether the fingers contact the fingering holes from a valid detecting signal with identification information FIG. 3 illustrates a detailed configuration diagram of the expiration intensity measuring unit illustrated in FIG. 1.

Figure 3:
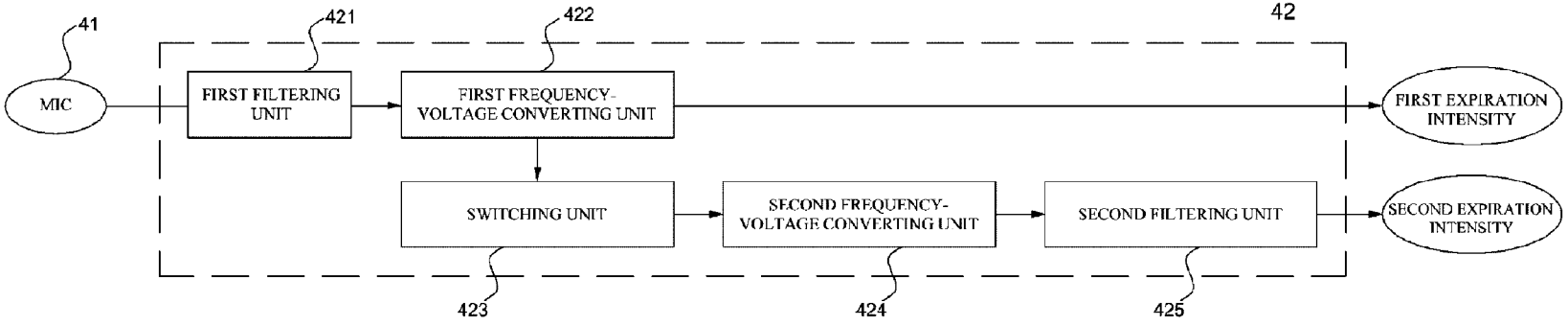
FIG. 3 is a detailed configuration diagram of an expiration intensity measuring unit illustrated in FIG. 1.

Referring to FIG. 3, the expiration intensity measuring unit 42 according to the present invention may at least include a first filtering unit 421, a first frequency-to-voltage converting unit 422, a switching unit 423, a second frequency-to-voltage converting unit 424, and a second filtering unit 425 in order to remove an unnecessary high frequency band from an electrical signal (AC voltage) output from the microphone and perform conversion on the electrical signal into a DC voltage output.

In detail, the first filtering unit 421 filters the electrical signal (AC voltage) output from the microphone 41 and passes only a specific set frequency band. The first filtering unit 421 may be a high-cut filter or a low-pass filter, but is not limited hereto and any circuit configuration of a type that is implemented to allow only a specific frequency band to be passed is possible. Here, as the specific frequency band, a frequency band of not higher than 100 Hz is preferred. In the present invention, the microphone 41 may be designed to remove a frequency band of not higher than 20 Hz, and a finally used frequency band may be a frequency band from 20 Hz to 100 Hz. For reference, the frequency band in a range of 20 Hz to 100 Hz is located lower than a band of most voice signals excluding an impulse such as an impact, and is not affected by surrounding voice or noise.

Furthermore, the first frequency-voltage converting unit 422 may perform DC voltage output conversion in proportion to an amplitude or power of a filtered frequency band. For example, the first frequency-voltage converting unit 422 may output the DC voltage as first expiration intensity through calculating a root mean square (RMS) value for the filtered frequency band.

Thereafter, the controller 43 compares the DC voltage output (the first expiration intensity) converted by the first frequency-voltage converting unit 422 with a preset first threshold value. As the comparison result, if the converted DC voltage output (the first expiration intensity) is not smaller than the first threshold value, the control unit 43 may generate note on information. Otherwise, the control unit 43 may generate note off information.

The switching unit 423 may receive the DC voltage (the first expiration intensity) converted by the first frequency-voltage converting unit 422, and compare the received DC voltage (the first expiration intensity) with a second threshold value. As the comparison result, if the received DC voltage (the first expiration intensity) is not smaller than the second threshold value, the switching unit 423 may receive the electrical signal (AC voltage) output from the microphone 41 without a change and deliver it to the second frequency-voltage converting unit 424. Otherwise, the switching unit 423 may not output any voltage signal or may output 0.

The second frequency-voltage converting unit 424 may perform DC voltage output conversion in proportion to an amplitude or power of the electrical signal (AC voltage) delivered from the switching unit. For example, the second frequency-voltage converting unit 424 may output the DC voltage as second expiration intensity through calculating an RMS value for the delivered electrical signal (AC voltage).

The second filtering unit 425 may remove noise from the converted DC voltage output (the second expiration intensity) and may be a low pass filter. The second filtering unit 425 may be omitted.

Thereafter, the controller 43 may generate velocity information corresponding to the noise-removed DC voltage output (the second expiration intensity) from the second filtering unit 425. Alternatively, when the second filtering unit 425 is omitted, the controller 43 may generate velocity information corresponding to the converted DC voltage output (the second expiration intensity) output from the second frequency-voltage converting unit 424.

In this way, the expiration intensity measuring unit 42 according to the present invention may measure expiration intensity (the first and second expiration intensities) by removing a sound component from a sound signal detected by the microphone 41 and calculating a voltage value (an RMS value) by a wind component. Accordingly, volume information including note on, note off, and velocity may be generated through the measured expiration intensity.

Figure 4:
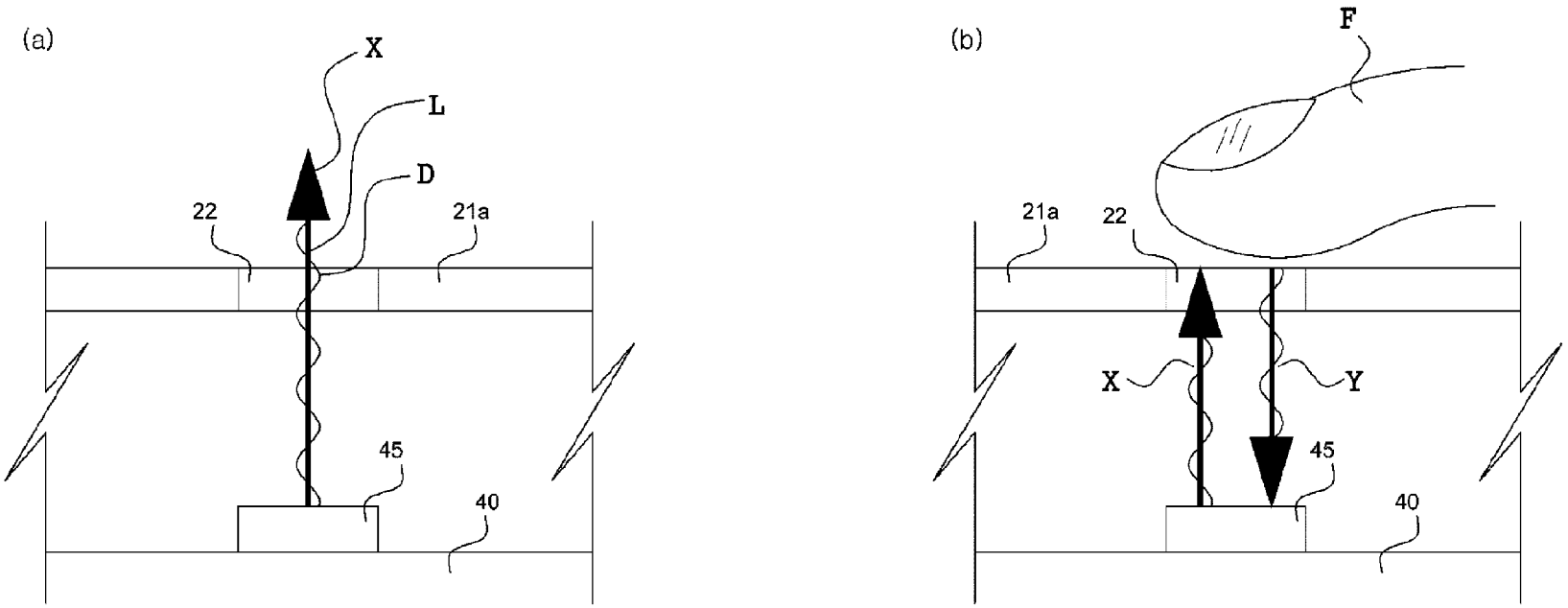
FIG. 4 is an exemplary view for explaining an operation principle of a proximity sensor illustrated in FIG. 1.

FIGS. 4A and 4B are exemplary views for explaining an operation principle of the proximity sensor illustrated in FIG. 1. FIG. 4A illustrates a state where there is not a finger contact with a fingering hole. FIG. 4B illustrates a state where there is a finger contact with a fingering hole. Here, it is described that the proximity sensor transmits and receives identification information together with light rays for detecting the finger contact. However, a configuration in which only the light rays are transmitted and received is possible, and, in this case, an operation thereof may be performed in the same operation principle as that of the configuration that light rays are transmitted and received together with the identification information. Therefore, description about this is omitted.

Referring to FIG. 4A, the proximity sensor 45 is disposed separate from the fingering hole 22 formed through the upper plate 21*a* of the intermediate plate. This proximity sensor 45 periodically transmits (X) the identification information D together with an infrared ray L, and the identification information D and the infrared ray L may be propagate externally through the fingering hole 22. Here, the identification information D may be a pulse data of 1 KHz, but is not limited hereto and any type that may check whether the infrared ray transmitted from the proximity sensor is reflected and received is useable.

Referring FIG. 4B, the transmission wave X transmitted from the proximity sensor 45 is reflected by a finger F contacted with the fingering hole 22 and is received (Y) by the proximity sensor 45. At this point, the reception wave Y received by the proximity sensor 45 includes the infrared ray and the identification information transmitted together with the infrared ray.

According to a first embodiment, the proximity sensor 45 may generate a detection signal without checking the received reception wave Y for whether the identification information D is received and deliver the detection signal to the controller 43.

On the other hand, according to a second embodiment, the proximity sensor 45 may check the received reception wave Y for whether the identification information D is received, generate a detection signal only when the identification information D is received, and deliver the detection signal to the control unit 43.

Accordingly, the proximity sensor according to the present invention may determine a valid detection signal through the identification information and prevent generation of a wrong detection signal, while a typical infrared sensor may receive an infrared ray from sunlight in the outside and generate a wrong detection signal.

Figure 5:
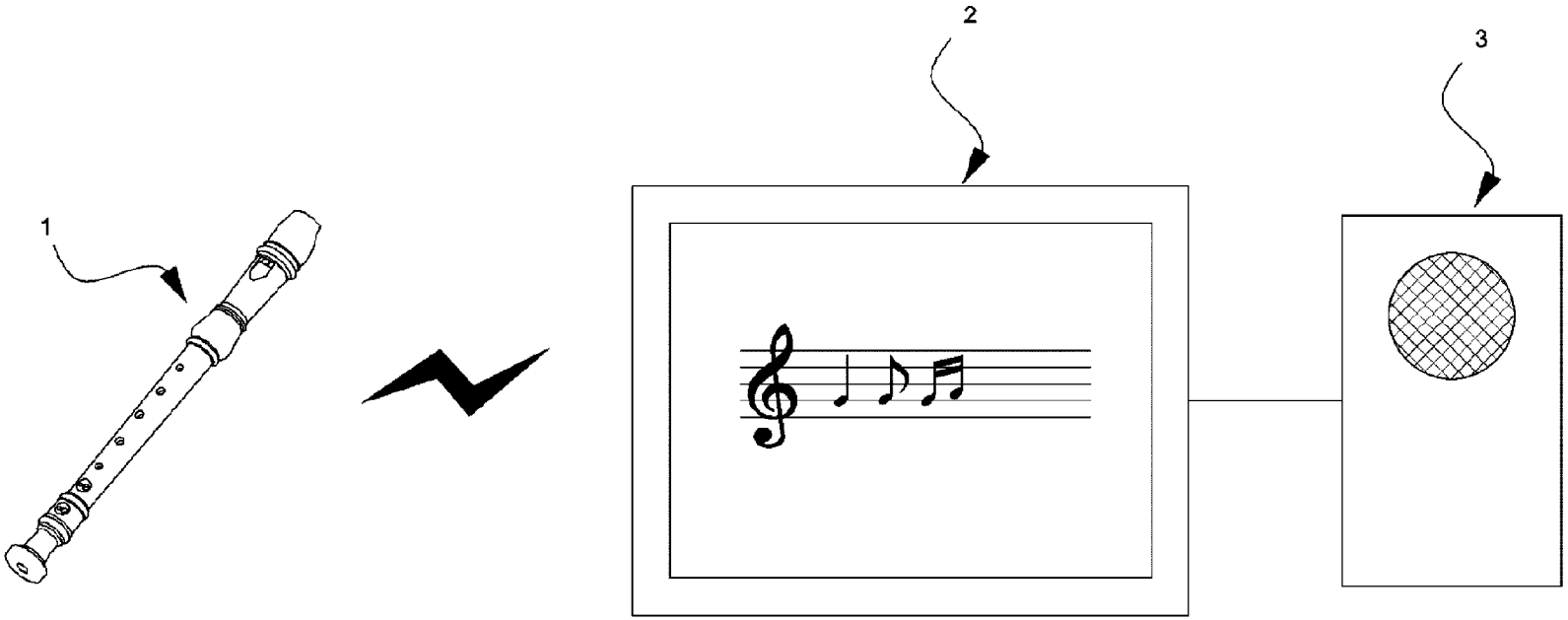
FIG. 5 illustrates a structure that the wind synthesizer controller illustrated in FIG. 1 and a display device is connected.

FIG. 5 illustrates a total system wherein the wind synthesizer controller illustrated in FIG. 1 is connected to a display device.

Referring to FIG. 5, the wind synthesizer controller 1 according to the present invention and the display device 2 may be connected through a wired network or a wireless network. Here, the wired network may use one or more selected from USB, PLC, LAN, RS-232, RS-485, RS-422, IEEE1394, and Home PNA, and the wireless network may use one or more selected from ZigBee, DSRC, RFID, Bluetooth, WLAN, WiFi, and Wibro.

In detail, the wind synthesizer controller 1 is played by a player, and a MIDI signal including volume and scale information generated by the wind synthesizer controller 1 is delivered to the display device 2. The display device 2 may receive the delivered MIDI signal, generate score images according to the scale information and display the images, and output musical sounds according to the scale and volume information through the speaker 3 connected to the display device 2.

For example, along with proceeding of music played by the player with the wind synthesizer controller 1, score images, namely, screens that scales according to fingering information are written on music paper may be output on the display device 2, and musical sounds may be output through the speaker 2 in concordance with the score images.

To this end, although not illustrated in the drawing, the display device 2 may include a controller therein which processes the MIDI signal and controls so as to output score images and musical sounds, and the controller may be implemented with a microcontroller.

For example, the controller may receive a MIDI signal input from the wind synthesizer controller, detect scale information and volume information (note data) from the MIDI signal according to playing manipulation and generate musical sounds, and configure scale images by using the detected scale information.

In this way, the wind synthesizer controller 1 according to the present invention may deliver a MIDI signal to an external electronic device such as the display device 2 through a wireless network such as Bluetooth as well as a wired network such as cable connection.

For a wind synthesizer controller according to embodiments of the present invention, a frequency band without noise can be obtained and, using this, intensity of expiration can be measured by using a microphone. Accordingly, more precise volume information can be generated.

Furthermore, according to embodiments of the present invention, a wind synthesizer controller is playable by the same manipulation as that of a customary musical instrument by obtaining fingering information by using non-contact sensors formed separately from fingering holes.

Furthermore, according to embodiments of the present invention, whether fingers contact with the wind synthesizer controller can be more accurately detected by configuring the non-contact sensors to transmit and receive identification information together with light rays. Accordingly, more precise fingering information can be obtained and more precise scale information can be generated.

Furthermore, according to embodiments of the present invention, a wind synthesizer controller having an identical shape to a customary musical instrument can be manufactured by using non-contact sensors prepared separately from fingering holes and a player can have a feeling of playing the customary musical instrument.

While the invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A wind synthesizer controller comprising:

a microphone detecting a sound generated by flowed in expiration;

an expiration intensity measuring unit measuring intensity of the expiration on the basis of a detected sound signal; and a controller generating volume information on the basis of the measured expiration intensity, wherein the volume information at least comprises note on, note off, and velocity, wherein the expiration intensity measuring unit filters the detected sound signal and passes a frequency band of a set cutoff frequency or lower, calculates a first DC voltage output for the filtered frequency band, and measures the first DC voltage output as first expiration intensity, and wherein, when the first DC voltage output is not smaller than a set threshold value, the expiration intensity measuring unit calculates a second DC voltage output for the sound signal detected by the microphone and measures the second DC voltage output as second expiration intensity.

2. The wind synthesizer controller of claim 1, wherein the filtered frequency band is a frequency band in a range from 20 to 100 Hz.

3. The wind synthesizer controller of claim 2, wherein, when the calculated first DC voltage output value is smaller than a first threshold value, the controller generates note off information, and, when the calculated first DC voltage output value is not smaller than the first threshold value, the controller generates note on information.

4. The wind synthesizer controller of claim 1, wherein the expiration intensity measuring unit further comprises a filter unit removing noise from the second DC voltage output.

5. The wind synthesizer controller of claim 4, wherein the controller generates velocity information on a sound corresponding to the calculated second expiration intensity.

6. The wind synthesizer controller of claim 1, wherein the controller generates velocity information on a sound corresponding to the calculated second expiration intensity.

7. The wind synthesizer controller of claim 1, further comprising a proximity sensor installed separately from a fingering hole at a position corresponding to at least one finger hole, and detecting a finger contact with the fingering hole, wherein the controller generates scale information on the basis of detection information of the proximity sensor.

8. The wind synthesizer controller of claim 7, wherein the proximity sensor is a non-contact sensor transmitting and receiving an infrared ray and identification information, and, when the infrared ray or the infrared ray and the identification information are received, the proximity sensor generates detection information.

9. The wind synthesizer controller of claim 8, wherein the controller checks whether the identification information is received for the detection information from the proximity sensor, combines fingering information in a case where the reception of the identification information is confirmed, and generates scale information corresponding to the combined fingering information.

10. The wind synthesizer controller of claim 7, wherein the proximity sensor is a non-contact sensor transmitting an infrared ray and identification information, receives infrared and identification information reflected by a finger contacting with the fingering hole, and generates detection information in a case where reception of the identification information is confirmed.

11. The wind synthesizer controller of claim 10, wherein the controller combines fingering information on at least one fingering hole on the basis of the detection information from the proximity sensor, and generates scale information corresponding to the combined fingering information.

12. The wind synthesizer controller of claim 7, further comprising a communication unit transmitting a converted MIDI signal to an external electronic device according to a control of the controller, wherein the controller converts the generated scale information and volume information into the MIDI signal.

13. The wind synthesizer controller of claim 12, wherein the communication unit comprises a wired communication unit communicating with a wired electronic device on a wired network using one or more selected from USB, PLC, LAN, RS-232, RS-485, RS-422, IEEE1394, and Home PNA, and a wireless communication unit communicating with a wireless electronic device on a wireless network using one or more selected from ZigBee, DSRC, RFID, Bluetooth, WLAN, WiFi, and Wibro.

* * * * *